US007581499B2

(12) United States Patent
Stark et al.

(10) Patent No.: US 7,581,499 B2
(45) Date of Patent: Sep. 1, 2009

(54) INSULATED CARTRIDGE CASE AND AMMUNITION, METHOD FOR MANUFACTURING SUCH CASES AND AMMUNITION, AND USE OF SUCH CASES AND AMMUNITION IN VARIOUS DIFFERENT WEAPON SYSTEMS

(75) Inventors: Ola Stark, Karlskoga (SE); Lennart Gustavsson, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 373 days.

(21) Appl. No.: 10/524,052

(22) PCT Filed: Aug. 7, 2003

(86) PCT No.: PCT/SE03/01253

§ 371 (c)(1),
(2), (4) Date: Oct. 5, 2005

(87) PCT Pub. No.: WO2004/015359

PCT Pub. Date: Feb. 19, 2004

(65) Prior Publication Data

US 2006/0096489 A1 May 11, 2006

(30) Foreign Application Priority Data

Aug. 8, 2002 (SE) ..... 0202387

(51) Int. Cl.
*F42B 5/08* (2006.01)
*F42B 5/297* (2006.01)

(52) U.S. Cl. ..... 102/472; 102/464

(58) Field of Classification Search ..... 102/465–467, 102/464, 468, 469, 472; 42/84; 89/58.5, 89/135

See application file for complete search history.

(56) References Cited

U.S. PATENT DOCUMENTS 2,196,018 A 4/1940 Korpiun
2,564,695 A * 8/1951 Johnson, Jr. et al. ..... 102/467
2,684,502 A * 7/1954 Paulve ..... 86/19.5
2,926,566 A * 3/1960 Atkins et al. ..... 89/28.05
2,972,947 A * 2/1961 Fitzsimmons et al. ..... 102/465

(Continued)

FOREIGN PATENT DOCUMENTS

EP 0736742 10/1996
WO WO-0177604 10/2001

OTHER PUBLICATIONS

International Search Report No. PCT/SE2003/01253 dated Oct. 14, 2003, 3 pgs.

*Primary Examiner*—Troy Chambers
(74) *Attorney, Agent, or Firm*—Connolly Bove Lodge & Hutz LLP

(57) ABSTRACT

The invention relates to a cartridge case (2) and ammunition round (1) primarily for electrothermal and/or electrothermochemical weapon systems, which round comprises the said cartridge case. According to the invention, the casing (10) of the cartridge case comprises or consists of one or more insulated or insulating shells, layers or surfaces (11, 12, 13) for, at least electrically, insulating the casing of the cartridge case from the barrel (14) of the weapon system and also preferably from at least the bottom (16) and/or firing device (5) of the ammunition round as well, but preferably also from the rest of the ammunition round, when the round is used, and also preferably from at least the bottom and/or firing device of the ammunition round as well, but preferably also from the rest of the ammunition round, when the round is stored and handled. The invention also relates to a method for manufacturing an, at least electrically, insulated or insulating cartridge case and an ammunition round primarily for electrothermal and/or electrothermochemical weapon systems, which round comprises such a cartridge case, and also use of such insulated or insulating cartridge cases and ammunition rounds in different weapon systems, but preferably in electrothermal and electrothermochemical weapon systems.

25 Claims, 4 Drawing Sheets

U.S. PATENT DOCUMENTS 3,034,433 A * 5/1962 Gronn ..... 102/464
3,144,827 A * 8/1964 Boutwell ..... 102/466
3,363,565 A * 1/1968 Walther ..... 102/472
3,749,021 A * 7/1973 Burgess ..... 102/467
3,752,080 A * 8/1973 Weyhmuller ..... 102/464
3,830,157 A * 8/1974 Donnard et al. ..... 102/464
4,187,271 A * 2/1980 Rolston et al. ..... 264/258
4,368,590 A * 1/1983 Palmer ..... 42/84
4,614,157 A * 9/1986 Grelle et al. ..... 102/466
4,738,202 A * 4/1988 Hebert ..... 102/467
5,021,206 A * 6/1991 Stoops ..... 264/155
5,115,743 A * 5/1992 Loffler ..... 102/472
5,165,040 A * 11/1992 Andersson et al. ..... 102/464
5,301,448 A * 4/1994 Petrick et al. ..... 42/70.01
5,331,879 A 7/1994 Loffler
5,898,124 A 4/1999 Krumm et al.
6,186,040 B1 2/2001 Weise et al.
6,237,494 B1 5/2001 Brunet et al.
6,340,469 B1 * 1/2002 McNally et al. ..... 424/438
6,397,508 B1 * 6/2002 Constant et al. ..... 42/84
6,703,580 B2 * 3/2004 Brunet et al. ..... 219/121.52
6,796,243 B2 * 9/2004 Schmees et al. ..... 102/472
6,845,716 B2 * 1/2005 Husseini et al. ..... 102/466
2002/0170455 A1 11/2002 Pierrot et al.

* cited by examiner

INSULATED CARTRIDGE CASE AND AMMUNITION, METHOD FOR MANUFACTURING SUCH CASES AND AMMUNITION, AND USE OF SUCH CASES AND AMMUNITION IN VARIOUS DIFFERENT WEAPON SYSTEMS

TECHNICAL FIELD

The present invention relates to a cartridge case and ammunition round primarily for electrothermal and/or electrothermochemical weapon systems, which round comprises the said cartridge case.

The invention also relates to a method for manufacturing such a cartridge case and an ammunition round primarily for electrothermal and/or electrothermochemical weapon systems, which round comprises the said cartridge case.

The invention also relates to use of the cartridge case and the ammunition round in other more conventional weapon systems than the said electrothermal and/or electrothermochemical weapon systems, but preferably in electrothermal and electrothermochemical weapon systems.

PROBLEMS AND BACKGROUND OF THE INVENTION

Various different propulsion principles exist today for accelerating projectiles through the barrel of a weapon system. The main division between these principles is based on whether projectile propulsion takes place by means of gas operation, electric operation or via a combination of these, at the same time as the propulsion principle(s) used in turn essentially determine which problems may arise in the different weapon systems.

Gas-operated weapon systems normally mean those systems which utilize the combustion gases which are formed after ignition of the propellant concerned for the shell, which propellant may now be liquid, solid or gaseous, although powder is still usually used. For example, in a conventional weapon, an ammunition round is fired by means of a firing device, normally a fuse, which ignites a propellent charge which, on combustion, develops a propellent gas quantity which is sufficiently powerful and expansive to accelerate the projectile rapidly out through the barrel of the weapon.

Electrically driven weapon systems instead utilize short electric pulses with high voltage and/or high current intensity in order to fire and propel the shell in ammunition adapted especially for electric operation.

In recent years, weapon systems based on combinations of both gas operation and electric operation, such as, for example, cannons which comprise either electrothermal propulsion or electrothermochemical propulsion, what are known as ETC cannons, have become increasingly important. In ETC cannons, use is made of, for example, electrical energy from a high-voltage source in order to bring about the actual ignition of the propellent charge, and then of on the one hand chemical energy from the combustion of this propellent charge and on the other hand electrical energy in the form of one or more pulses in order to supply more energy to the propellent gas in the form of plasma formation from the latter or via the creation of an electric potential difference along the barrel in order to increase the speed of the projectile.

In many hitherto known electrothermochemical weapon systems, the conventional fuse is replaced by a plasma generator. The plasma generator is filled with a preferably metal material which, via the electric pulses, is heated, vaporized and finally partly ionized, a plasma being produced, which, depending on the type of plasma generator, flows out through the front opening of the plasma generator or through a number of openings along its sides, what is known as a "piccolo". The very high temperature (roughly 10,000° K) of the plasma influences the combustion of the propellant in several positive ways, which together result in a desired higher muzzle velocity of the projectile.

Rather briefly, it can be said that a typical modern ETC cannon consists of a cannon, the shell projectiles of which are essentially powder-gas-propelled, but where the shell is fired by means of electric ignition and its projectile is given an extra "push" via the plasma formation in connection with combustion of the propellent charge. However, there are also ETC cannons in which, after firing by means of a conventional fuse add "normal" combustion of the powder charge carried out subsequently, extra electrical energy is supplied to the projectile via the propellent gas further forward in the barrel by devices specially arranged there (see, for example, U.S. Pat. No. 5,546,844).

The technical problems which form the basis of the present invention are on the one hand the handling and storage problems which exist or can arise in the different weapon systems due to the weight, the moisture-sensitivity, the risk of electric short-circuiting etc. of the shell, and on the other hand the specific risk for ETC cannons that the cartridge case burns on in the barrel owing to electric short-circuiting between the cartridge case and the barrel. This is because the modern conventional cartridge case is manufactured from electrically conductive metal, usually brass. The burning-on is caused by the current and/or the voltage used during firing being intentionally or unintentionally conducted across to the cannon/artillery piece via the barrel. Moreover, the fact that the cannon/artillery piece becomes live constitutes an extra disadvantage for the gun crew.

It is therefore highly desirable to produce a new type of ammunition which is different from the abovementioned electrically conductive metal ammunition, has a considerably lower projectile weight than all comparable ammunition for conventional weapon systems and moreover is electrically insulated in order to prevent short-circuits and to minimize the risk of all or parts of the cartridge case burning on in the chamber or in the barrel.

PRIOR ART

Patent specification U.S. Pat. No. 6,186,040 describes a known plasma torch arrangement for electrothermal and electrothermochemical cannon systems where the necessary current and voltage are transferred to the plasma fuse via the rear part of the latter and then on to earth via the case jacket of the round and the barrel of the cannon system. A major problem in plasma cannons of this type is therefore that they use the cannon barrel as a counterelectrode, and so these constructions also apply current and voltage to the cannon barrel itself and thus other important parts of the weapon system concerned. Apart from the obvious disadvantages of this, such as the risk of personal injury as a result of electrical hazard and short-circuiting of the weapon system, it is clear that there is a considerable risk of the cartridge case burning on in the barrel when current and voltage are conducted across to the cannon.

An electrothermal firing arrangement with associated ammunition is also known from U.S. Pat. No. 5,331,879, where the arrangement comprises a barrel which comprises an inner "combustion chamber part", in which the propellent charge burns, and an outer "projectile guide part" for accelerating the projectile. The ammunition comprises an only partly electrically insulated cartridge case, as the front part adjacent to the projectile consists of a front electrode which is electrically connected to the said projectile guide part of the barrel. The current transfer path for the arrangement via the ammunition therefore consists of an earthed metal breech block for current supply, a first and second electrode of the round between which a metal wire runs, and the barrel itself. It is easy to see that such a design of a cannon barrel constitutes neither a conventional construction nor a valid solution for conventional use in the field in a real weapon system, as opposed to here in a theoretical laboratory construction. For example, the ammunition round does not have a cartridge case proper, as the cartridge case and the firing device are the same component here. The projectile can therefore be considered to be mounted directly at the end of a fuse, as a result of which the round is always armed and cannot be disarmed without being destroyed at the same time.

It is true that the combustion chamber part and the projectile guide part have been insulated from one another via a high-voltage seal made of rubber or silicone rubber arranged between them, but the rubber will age very rapidly and be destroyed by use, after which the problems of short-circuiting etc. described above will occur. Moreover, it has been necessary to insulate, in addition to a small area intended for a cable terminal for the front electric connection, the entire front part of the barrel with a surface coating on its outside.

In addition to the constructions with metal barrels exemplified above, alternative barrels made in their entirety of non-conductive material have also been manufactured. An example of these is inter alia the grenade sleeve of the Carl-Gustaf anti-tank rifle, which is today manufactured from wound, glass-fibre-reinforced epoxy. In this case, however, the selection of material would be due to the resulting weight reduction.

One problem in the use of such non-metal barrels for conventional barrels as well is that the pressure from the combustion of the propellent charge will burst the barrel when the latter is closed at the rear end, which is of course the case in, for example, conventional artillery pieces, anti-tank weapons, cannons for tanks etc.

OBJECTS AND FEATURES OF THE INVENTION

An important object of the present invention is therefore to produce a new type of insulated or insulating cartridge case and ammunition round primarily for electrothermochemical weapon systems, which cartridge case and which ammunition round are insulated in such a way that they considerably reduce or completely eliminate all the abovementioned problems and in particular the problems of the application of current and voltage to the barrel and other sensitive parts of the weapon system and also the risk of the cartridge case burning on in the said barrel and chamber.

Another object of the present invention is to produce cartridge cases and ammunition for use in weapon systems other than the said electrothermochemical weapon systems, which cartridge cases and which ammunition moreover have a considerably lower total weight compared with conventional ammunition.

It is also an object of the present invention to produce a new method for manufacturing cartridge cases and ammunition which are insulated in relation to their surrounding environment, that is to say which are not only electrically insulated but which can also be insulated with regard to water, moisture, temperature etc.

The said objects, and other aims not listed here, are achieved within the scope of what is stated in the present independent patent claims. Embodiments of the invention are indicated in the dependent patent claims.

The solution according to tie present invention is, in a way described in greater detail below, to replace the normally heavier, metal cartridge case with a lighter case which is electrically insulated or which is made of a material which does not conduct current, for example a plastic, ceramic or glass-fibre material etc. The result of the said insulation or replacement is that electric flashover, that is to say a short-circuit, normally cannot happen, and in most cases a considerable weight reduction as well and also thermal insulation etc. are obtained when a metal case is replaced with a non-metal case.

Examples of suitable replacement materials are polyethylene, glass-fibre-reinforced epoxy etc.

According to the present invention, an improved cartridge case and ammunition round comprising the said cartridge case have therefore been produced, which are characterized in that:

the casing of the cartridge case comprises or consists of one or more insulated or insulating shells, layers or surfaces for, at least electrically, insulating the casing of the cartridge case from the barrel of the weapon system and also preferably from at least the bottom and/or firing device of the ammunition round as well, but preferably also from the rest of the ammunition round, when the round is used, and also preferably from at least the bottom and/or firing device of the ammunition round as well, but preferably also from the rest of the ammunition round, when the round is stored and handled.

According to other aspects of the cartridge case and the ammunition round according to the invention:

the casing of the cartridge case comprises a load-bearing case shell, for example in the form of a conventional cartridge case manufactured from an electrically conductive metal, for example brass, and also at least one inner and/or outer coating, surface or layer, of which at least the shell or one inner and/or outer coating, surface or layer is dielectric for electric insulation of the case in relation to at least the barrel and preferably also to the bottom and/or firing device of the ammunition round, but preferably also to the rest of the ammunition round;

the cartridge case has a casing which comprises at least one inner and/or outer coating, surface or layer which is a mechanically applied layer or a chemically or electrochemically applied surface;

at least one inner and/or outer coating, surface or layer consists of a material applied by phase transformation, such as vaporization and condensation to form an insulating film, preferably a dimeric or polymeric raw material comprising hydrocarbons, such as poly-para-xylylene or another suitable plastic;

at least one inner and/or outer shell or layer consists of shape-imitating shrink film or flexible tube made of preferably non-conductive material, such as rubber or plastic;

the casing of the cartridge case comprises or consists of a non-conductive or electrically insulating load-bearing material, shell, layer or surfaces, such as hard plastic, ceramic, rigid rubber, fibre composite etc.;

the casing of the cartridge case comprises or consists of a relatively flexible non-conductive or electrically insulating shell or layer which is constructed from a glass-fibre laminate comprising woven glass-fibre fabric and glass-fibre thread, for example glass-fibro-reinforced epoxy in the form of a case jacket wound in a number of plies;

the casing of the cartridge case has a thread winding which is arranged along the case jacket at a winding angle $\alpha$ defined for each ply to the longitudinal axis Y of the case, and which casing includes several different thread-winding angles α for bringing about locking of the glass fibre, preferably at least 4 different angles α in relation to the longitudinal axis Y of the case;

the firing device is arranged detachably on a bottom integrated with the casing of the cartridge case or on a separate bottom piece arranged preferably demountably with the casing;

the separate bottom piece is manufactured with an interference fit to the cartridge case jacket which is greater than the expansion possibility of the round in the cartridge chamber plus the maximum compression which can be brought about by the inner overpressure when firing takes place;

the round also comprises at least one projectile, and, enclosed in the cartridge case, a propellent charge which essentially follows the inner dimensions of the case;

the shrink film or the tube is arranged directly on the outside of the propellent charge;

the propellent charge consists of a cartridge-shaped charge which is surrounded by an outer shrink film or flexible tube for forming a cartridge-shaped, and if appropriate vacuum-packed, round which stands up to normal handling of the round;

the bottom piece is electrically non-conductive, suitably made of glass-fibre epoxy, and arranged on the rear end of the casing in a tight-fitting manner by means of screw-thread cutting, adhesive bonding or by means of another connection suitable for the function;

the bottom and/or the rear end of the firing device comprise(s) an electric connection, by means of which the ammunition round, once introduced into the chamber of the weapon concerned, is in electric contact with the high-voltage source of the weapon concerned via the firing device;

the firing device comprises an outer, electrically conductive metal combustion chamber which is arranged projecting from and detachably fastened to the rear end of the cartridge case, and a central electrode arranged inside the chamber, the central electrode comprises a first, "input" electric connection, the rear end of the combustion chamber comprises a second, "output" electric connection, an electrically insulating device is arranged between the said two, "input" and respectively "output", electric connections and along the entire length of the combustion chamber between the said "input" electric connection and a front opening arranged on the plasma torch, at least one but preferably more electric conductors extend inside the combustion chamber and the electrically insulating device, between the first, "input" electric connection and the front opening of the combustion chamber, the combustion chamber, the electric conductors and the central electrode all being electrically conductive, as a result of which the current transfer path, the polarity of which can be changed, for the necessary current and voltage is therefore arranged so as to run from the first, "input" electric connection and on to the front opening of the combustion chamber via the electric conductors for ionization of these to form a very hot, expansive plasma, which squirts out through the said front opening, for igniting the propellent charge, and finally from the plasma and the front opening of the combustion chamber back to the "output" electric connection via the casing of the combustion chamber;

the firing device of the ammunition round can consist of a fuse for use of the cartridge case and the ammunition round in other more conventional weapon systems than the said electrothermal and/or electrothermochemical weapon systems.

According to the invention, furthermore, the method for manufacturing the said cartridge case and ammunition is characterized in that:

at least one of the shells or layers which form part of the casing of the cartridge case is manufactured by glass-fibre thread being wound with resin in thin layers with varying winding angles α sandwiched with woven glass-fibre fabric so that a plurality of winding plies/laminate layers are obtained after hardening.

According to other aspects of the method for manufacturing the cartridge case and the ammunition round according to the invention:

for every such winding ply/laminate layer, a fibre winding with fibre angles of essentially roughly 90° to the longitudinal axis of the tube on the inside and +/− roughly 15-25°, preferably +/−20°, on the outside is selected, and a number of such winding plies are laid on top of one another and sandwiched with woven glass-fibre fabric between a number of the thread-winding plies so that an essentially flexible case jacket is obtained, as a result of which the casing of a round introduced into the cartridge chamber tolerates being expanded towards the walls of the cartridge chamber by the inner overpressure inside the cartridge case brought about when firing takes place without for that reason cracking, delaminating or disintegrating;

at least one of the shells or layers which form part of the casing of the cartridge case is manufactured by an innermost, tightly woven glass-fibre fabric first being applied to a winding and shaping tool which is rotated while the fabric is draped over it, the last piece of the woven glass-fibre fabric being laid so that a small overlap is formed, after which a first winding ply of glass-fibre thread in resin is wound with a fibre angle to the longitudinal axis of the tube of essentially 90°, followed by two or more winding plies of thread with a fibre angle, which is varied for the component plies, of on the one hand roughly +15-25°, preferably +20°, and on the other hand roughly −15-25°, preferably −20°, after which the subsequent, thin winding plies/laminate layers are also given a fibre winding with a fibre angle to the longitudinal axis of the tube which varies between essentially roughly 90° and +/±roughly 15-25°, preferably +/±20°, as the thickness of the casing is built up to roughly half-thickness, after which woven glass-fibre fabric is sandwiched with fibre windings with a fibre angle of essentially 90° until full shell or layer thickness has been achieved;

a relatively low winding speed is used, preferably roughly 4-6 m/min, while a relatively high thread tension, roughly 21-23N/roving, and a hardening cycle which comprises a plurality of hardenings at increasing temperatures are selected;

use is made of a hardening cycle of roughly 5 hours at roughly 80°, followed by roughly 5 hours at roughly 120°, after which after-hardening takes place for roughly 4 hours at roughly 140°;

after shaping of a blank for the casing, this is cut and/or turned/ground to essentially the desired length, thickness and predetermined shape, after which a bottom piece is mounted on the rear end of the casing in a tight-fitting manner, preferably by adhesive bonding or screw-thread cutting;

the bottom piece is manufactured from glass-fibre epoxy, either by glass-fibre thread and/or woven glass-fibre fabric being given during shaping the form of a hammock where only tensile loads in the fibres can occur or by glass-fibre thread and/or woven glass-fibre fabric being given during shaping the form of a plane bottom so that pressure loads can also occur, after which the bottom piece, after shaping and hardening have been completed, is then turned out, attention being paid to obtaining the correct interference fit for the casing concerned;

the bottom piece is manufactured from an electrically conductive material, suitably from metal;

an insulation coating is applied over all the shell or layer surfaces of the cartridge case concerned which are accessible to gas by phase transformation via a number of phases, a dimeric or polymeric raw material being vaporized so that the polymer or the dimer is first transformed from solid phase to gas phase and then, at a further increased temperature, is transformed to a reactive monomer gas which is made to condense and polymerize, a thin insulating plastic film layer being deposited on all the free surfaces of the cartridge case;

the condensation of the reactive monomer gas to form an insulating film takes place under low pressure, preferably in a vacuum.

The use of such cartridge cases and ammunition according to the invention is characterized in that the firing device of the ammunition round can consist of a fuse for use of the cartridge case and the ammunition round in other more conventional weapon systems than the said electrothermal and/or electrothermochemical weapon systems.

ADVANTAGES OF THE INVENTION

The advantages include the fact that, compared with the conventional metal cases, a considerable weight saving (roughly 70%) is obtained while the ammunition quantity remains the same. Alternatively, if the storage space allows, a greater quantity of ammunition can be carried in spite of an unchanged total weight.

From a technical point of view, manufacturing is simple, as a result of which the cases can be manufactured with uniform and high quality for a low manufacturing cost. The form and execution selected for the winding plies result in tight laminate shells, which prevent overpressure being built into the casing of the case, a high expansion capacity without the case cracking, and also the laminate sealing itself the more the overpressure in the round increases. Moreover, the cases have great impact-resistance at the same time as they tolerate a certain delamination in the event of careless handling.

By using a cartridge case made of electrically insulating material, that is to say non-conductive plastic, glass fibre, ceramic etc., or by using a metal case which has been provided with a coating, surface or layer which insulates the case electrically, for example by vaporization of a plastic to form an insulating plastic film of suitable thickness, the risk of flashover, that is to say electric short-circuiting, has on the whole been eliminated.

Even if the current should happen to be conducted across to the cannon/artillery piece when firing of a round takes place, the cartridge case will not burn on in the barrel, which is often the result when the cartridge case is made of metal.

LIST OF FIGURES

The invention will be described in greater detail below with reference to the accompanying figures, in which FIG. 1 is a diagrammatic perspective view of a round comprising an insulated or insulating cartridge case according to the present invention, which round is here intended in particular for an electrothermochemical weapon system;

DETAILED DESCRIPTION OF EMBODIMENTS

Figure 1:
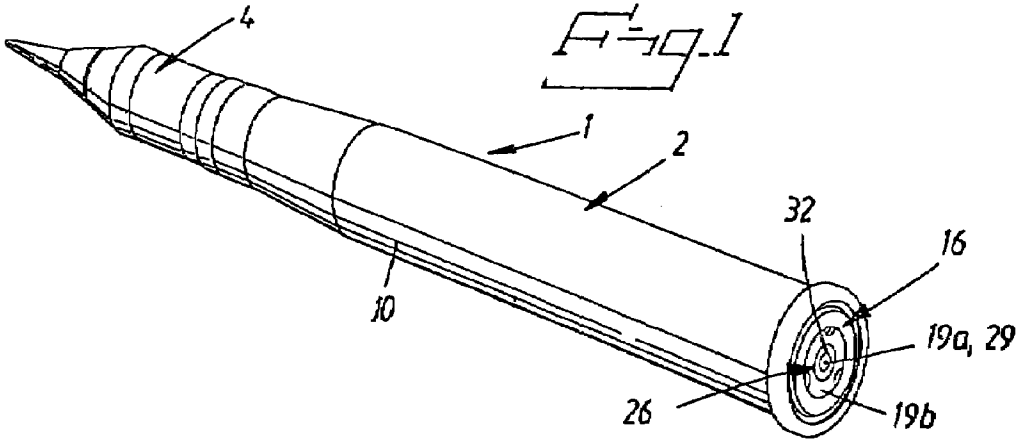

With reference to FIG. 1, a perspective view is shown of an ammunition round 1 comprising an, at least electrically, insulated or insulating cartridge case 2 according to the present invention. Here, the round 1 is intended in particular for an electrothermochemical (ETC) weapon system comprising armour-piercing dart ammunition for use in tanks, combat vehicles and various anti-tank weapons but also in, for example, combat aircraft, anti-aircraft weapons and other artillery.

It will be understood, however, that the round 1 shown is not only intended for such ETC ammunition and that it can also include several different sizes and projectile types depending on the area of use and calibre. Here, however, it is at least the commonest ammunition types today, between roughly 25 mm and 160 mm, which are concerned.

The expressions "at least electrically insulating" or "at least electrically insulated" mean that the material, the case etc. so designated can also function as insulating or be insulated in relation to the surrounding environment with regard to water, moisture, temperature etc.

Figure 2:
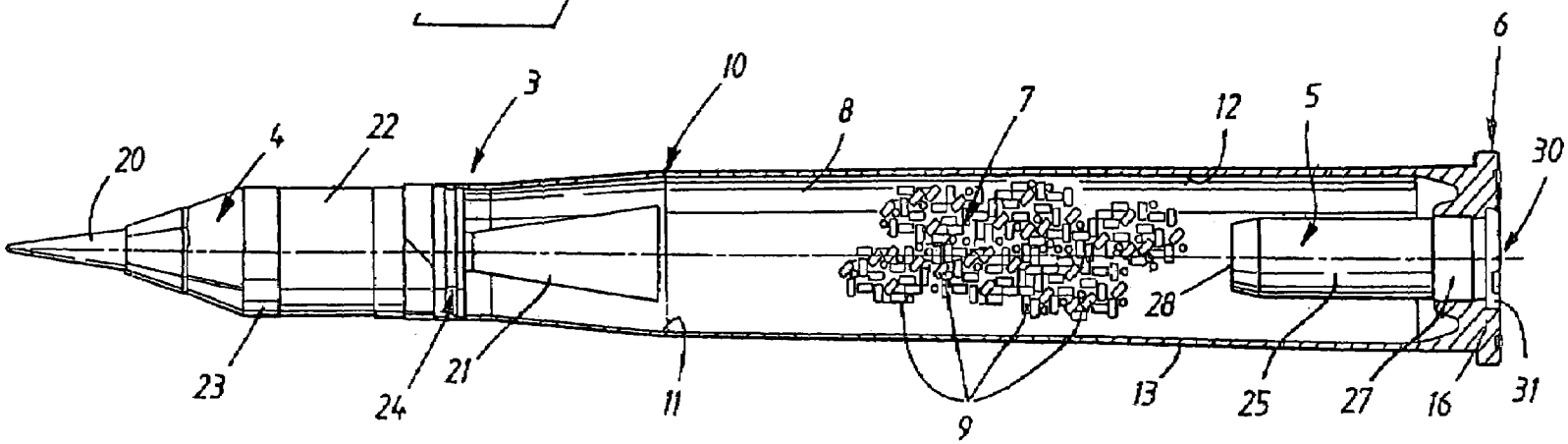
FIG. 2 is a diagrammatic longitudinal section through parts of the round according to FIG. 1, which longitudinal section shows inter alia a plasma torch arranged inside the insulated or insulating cartridge case.

FIG. 2 shows a diagrammatic longitudinal section through parts of a first embodiment of the round 1 according to FIG. 1, which round 1 also comprises, in addition to the said insulated or insulating cartridge case 2, a projectile 4 mounted at the front end 3 of the cartridge case 2, a firing device in the form of a plasma torch 5 arranged at the rear, flanged end 6 of the round 1, and a propellent charge 7 which is enclosed in the cartridge case 2 and is indicated diagrammatically only in the centre of the case 2. Preferably, however, the entire cavity 8 of the case 2 is filled with a propellent charge 7 which can consist of a solid powder or a suitable liquid propellant. The solid propellent charge 7 suitably consists of what is known as a progressive perforated powder provided with a large number of holes in the form of one or more, for example cylindrical, bars, plates, blocks etc., which powder essentially follows the inner dimensions of the case 2, or of a charge comprising grain powder, also known as powder pellets 9, for example a compacted NC powder grain charge. In this connection, the said powder grains 9 have first been treated with a suitable chemical in order to bring about adhesion between the individual grains 9, after which the grains 9 are pressed together to form a charge 7 with a desired shape determined by the cavity 8. Alternative embodiments of the powder charge 7 also include multi-perforated double-base (DB) powder with inhibition, Fox 7, AND, nitramine, GAP and other known powder types.

It applies generally that the cartridge case 2 comprises an, at least electrically, insulating and/or electrically insulated casing 10. This casing 10 can then consist of only one or the same essentially homogeneous material layer, shell or laminate 11 which is then dielectric (that is to say non-conductive), for example a fibre composite, or of a combination of several different shells, layers or surfaces 11, 12, 13, where at least one of these acts in an electrically insulating manner for the others and for the cartridge case 2 as a whole.

A combined casing 10 (compare FIG. 4) can, for example, consist of an essentially supporting or load-bearing shell 11 and also at least one inner 12 and/or outer 13 mechanically applied layer or chemically applied surface, that is to say coating. The essentially supporting or load-bearing shell 11 is preferably non-conductive and then suitably made of glass-fibre epoxy, rubber etc., but the said shell 11 can be conductive, in which case at least one of the inner and/or outer layers or surfaces 12, 13 of the casing 10 is then dielectric in order to bring about the said electric insulation of the inside and/or outside of the casing 10 in relation to at least the barrel 14 and preferably also to the plasma torch 5.

Preferably, the casing 10 (see FIGS. 5 and 6) is constructed from a glass-fibre laminate comprising a thin tight woven E-glass fibre fabric on the inside, suitably what is known as a Fothergill fabric, on the outside of which E-glass fibre thread (for example R25 glass) is wound with resin in thin layers with varying winding angles α sandwiched with further woven E-glass fibre fabric (see below).

In an example of the said embodiment of a cartridge case 2 with a conductive shell 11, the case comprises a load-bearing, metal shell 11, on which a plastic film coating 12, 13 (see below) has been applied. See in particular FIG. 4 which shows a load-bearing shell 11 made of brass which has been insulated with, for example, shrink film or a plastic film coating 12, 13 in order to bring about electric insulation in relation to the barrel 14. Here, load-bearing 11 or supporting shell means that a load-bearing shell 11 in itself stands up to normal stresses without being deformed appreciably during handling of the case 2 and the round 1, while supporting means an essentially flexible shell which is, for example, arranged directly on the outside of the propellent charge 7 without an inner, rigid case casing being present, the shell together with the propellent charge 7 then standing up to the said normal handling of the round 1. An example (not shown) of a round comprising a supporting shell will consist of an inner cartridge-shaped charge which is enclosed in an outer shrink-film or flexible tube which surrounds the charge and is shaped according to the said cartridge-shaped charge. If appropriate, extra rigidity can be obtained by vacuum-packing.

In this connection, the supporting shell is arranged so that it extends between the projectile and the bottom piece with a rigidity as is required for the function. In this embodiment, after firing the finished round, only the metal bottom of the cartridge case remains, and the rest is combusted in the barrel.

Figure 4:
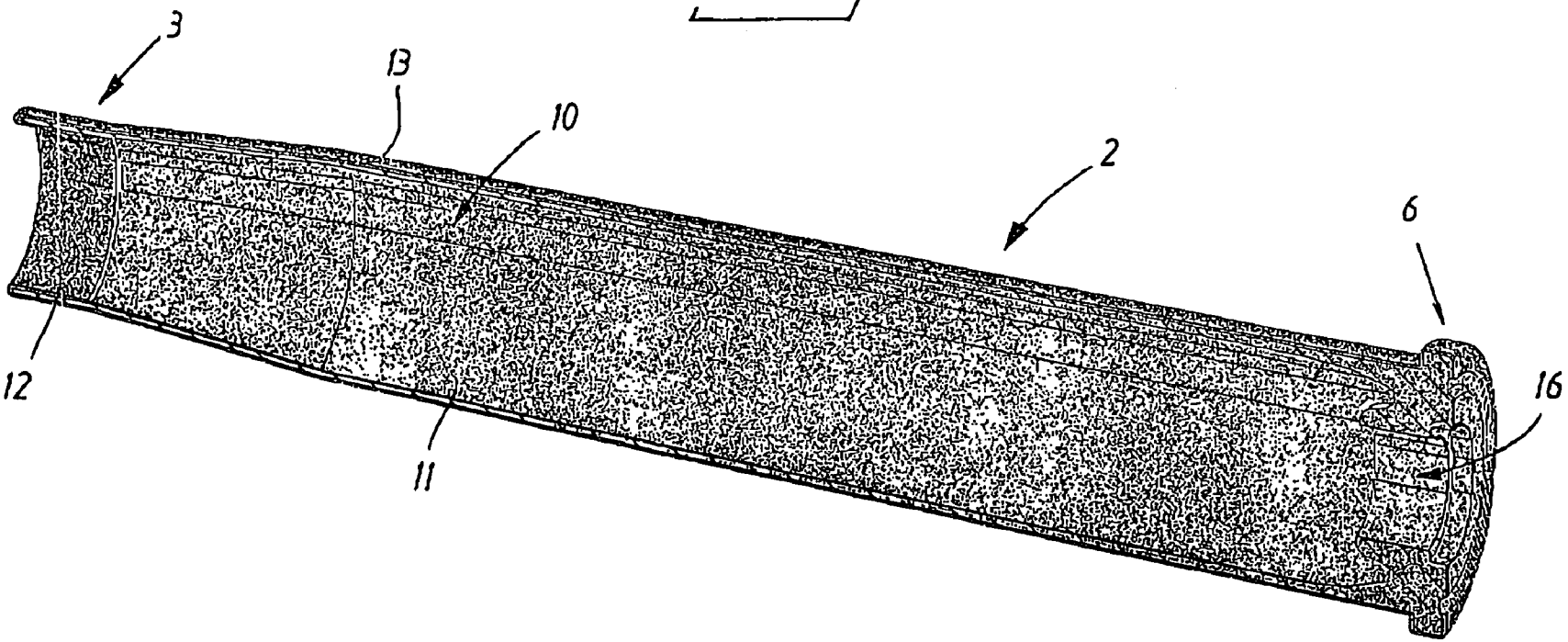
FIG. 4 is a diagrammatic longitudinal section through parts of the cartridge case for the round according to FIG. 1.
Figure 6:
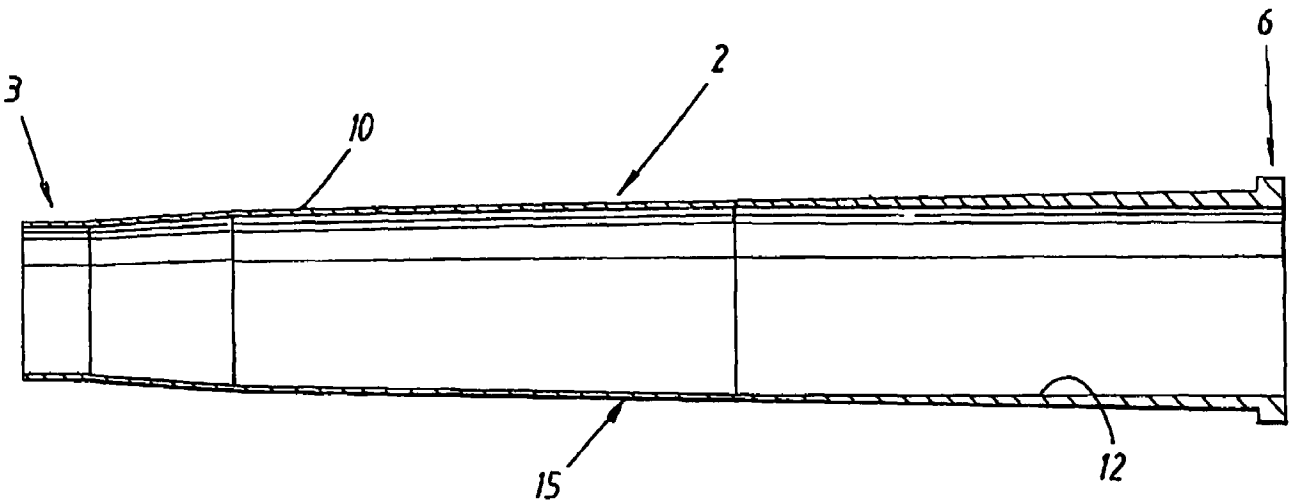
FIG. 6 is a diagrammatic longitudinal section through the cartridge case according to FIG. 5.

In the embodiments of the cartridge case 2 according to the invention shown in particular in FIGS. 4 and 6, these comprise an at least electrically insulating and/or electrically insulated casing 10 which consists of a load-bearing shell 11, on the outside of which an outer layer or surface 13 is (see FIG. 4) or can be arranged (FIG. 6). Either of or both the shell 11 and the outer layer or surface 13 is then dielectric, the layer suitably consisting of the abovementioned shape-imitating shrink film or elastic tube, while the surface consists of a suitable insulating coating. If the shell 11 consists of a glass-fibre composite, for example, the said layers or surfaces 12, 13 can instead consist of, for example, a coating which increases wear protection or moisture protection in order to bring about a reduction of the stresses on the shell 11 or respectively an improvement of the moisture protection for the round 1. An example of a suitable electric insulation coating is a dimeric or polymeric raw material comprising hydrocarbons, such as poly-para-xylylene.

In the other embodiment of the cartridge case 2 according to the invention shown in FIG. 6, the case has an electrically insulating casing 10 which comprises a relatively flexible laminate shell 11 in the form of a case jacket 15, wound in several plies, suitably made of glass-fibre-reinforced epoxy, for example of polyethylene like the abovementioned barrel for the Carl-Gustaf anti-tank rifle. The glass-fibre reinforcement comprises a number of wound plies of thread and/or fabric, preferably both. In a special embodiment of the cartridge case 2, the casing 10 is constructed from a glass-fibre laminate comprising a thin tight woven E-glass-fibre fabric on the inside, suitably what is known as a Fothergill fabric, on the outside of which E-glass fibre is wound with thin layers sandwiched with further woven E-glass-fibre fabric. Suitably, the thread-winding is arranged along the case jacket 15 at a winding angle α defined for each ply, which varies in relation to the longitudinal axis Y of the case 2. In order to bring about locking of the glass fibre, it is essential that the casing 10 contains a number of different fibre directions which lock one another, preferably at least 4 different directions in relation to the longitudinal axis Y of the case 2, for example essentially roughly 0°, 90° and +/− roughly 15-25°, preferably +/−20°.

Figure 5:
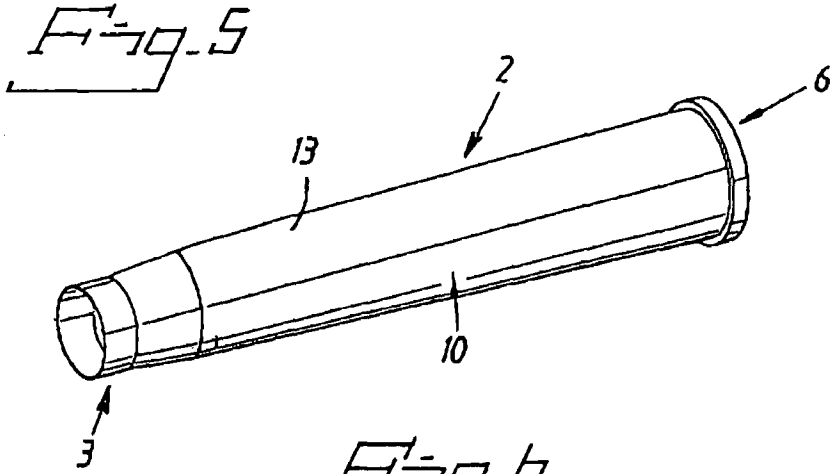
FIG. 5 shows diagrammatically a perspective view of an alternative cartridge case made of, for example, glass-fibre-reinforced epoxy for use in a round according to the invention.

In the embodiment according to FIGS. 5 and 6, a separate bottom piece 16 (not shown), which can be either electrically conductive or non-conductive, suitably made of metal material or of glass-fibre epoxy, is also arranged on the rear end 6 of the case jacket 15 in a tight-fitting manner by means of screw-thread cutting, adhesive bonding or by means of another connection suitable for the function (compare FIG. 1 where the round 1 instead comprises a bottom 16 which is integrated with the rest of the casing 10 of the cartridge case 2). In the embodiment according to FIGS. 5 and 6, the bottom piece 16, including the plasma torch 5, can therefore be arranged unscrewably from the rest of the cartridge case 2 or be more or less permanently fastened thereto. The detachably arranged plasma torch 5 also affords the possibility of replacing the plasma torch 5 with a conventional fuse, as a result of which the round can thus be used in a conventional weapon system, that is to say in the abovementioned only gas-operated systems as well.

However, when the round 1 according to the embodiment with the separate bottom piece 16 is fired, there is an obvious risk that undesirable pressure forces can penetrate between the cartridge case jacket 15 and the bottom piece 16. These pressure forces can then split apart the laminate in the case jacket 15 and in the bottom piece 16. In order to minimize the risk of this happening, the separate bottom 16 is manufactured with an interference fit to the cartridge case jacket 15 which is greater than the expansion possibility of the round 1 in the cartridge chamber plus the maximum compression which can be brought about by the inner overpressure when firing takes place. Moreover, a rubber ring seal (not shown) can be mounted between the cartridge case jacket 15 and the bottom piece 16 to bring about extra sealing.

Figure 3:
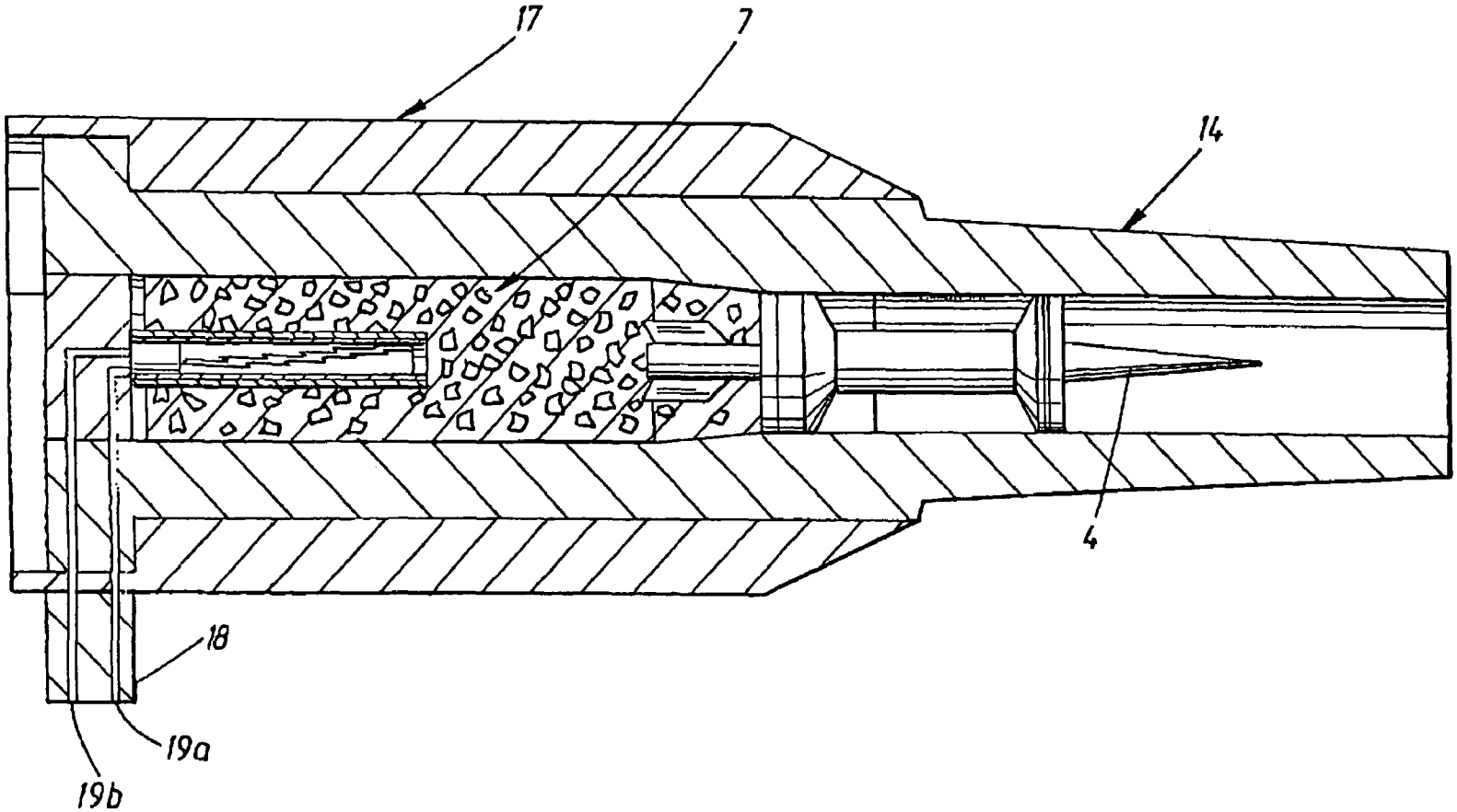
FIG. 3 is a longitudinal section through parts of a diagrammatic weapon for firing the round according to FIG. 1.

The abovementioned metal bottom 16 and/or the rear end 30 of the plasma torch 5 (see below) lie(s) against the chamber 17 of the weapon concerned (see FIG. 3), as a result of which the plasma torch 5 is in electric contact with a high-voltage source 18, the polarity of which can be changed, via an electric connection 19. After the current/voltage has been transferred to the fuse/plasma torch 5, it is returned via the outer casing 15 of the latter 5 to its rear part 30 and the electric connection 19. By virtue of the fact that the current follows the easiest path through the plasma torch 5, which path is via the plasma formed, and because the cartridge case 2 according to the embodiments described above consists of one or more materials which do not conduct current or voltage across to the barrel 14, there is therefore no risk of flashover/short-circuiting or of the cartridge case 2 burning on in the weapon/cannon concerned.

In the embodiments of the round 1 shown in the figures (see in particular FIG. 2), the projectile 4 comprises an armour-piercing dart 20 with a guide cone or guide fins 21, which armour dart 20 is at least partly enclosed in and supported inside the case casing 10 by a multi-part dart support body 22. Arranged around the body 22 is a belt 23 made of plastic for sealing the round 1 in relations to the inside of the barrel 14. A connection 24 in the form of, for example, grooving, adhesive bonding etc. connects the projectile 4 to the casing 10 of the cartridge case 2 (see FIG. 2). Amour-piercing dart ammunition 1 achieves its great effect because the dart 20 has a considerable weight (density roughly 17-20 g/cm$^3$, for example tungsten).

The plasma torch 5 (see FIG. 2), which constitutes the equivalent of the ETC round 1 to a conventional fuse with suitably the same or similar external shape as the latter, comprises an outer, electrically conductive combustion chamber 25 and, arranged inside the latter, a central electrode 26. Here, the combustion chamber 25 is in the form of a metal cylindrical tube which projects from and is detachably fastened to the rear end 6 of the cartridge case 2 by means of a suitable external screw thread 27. In the embodiment shown in FIG. 2, the plasma torch 5 is screwed firmly to the bottom 16 integrated with the casing 10 of the cartridge case 2 or to the bottom piece 16 arranged demountably with the casing 10.

The plasma torch 5 also comprises a front opening 28. The central electrode 26 comprises a metal, cylindrical contact device 29 for bringing about a first "input" electric connection 19*a*. The rear end 30 of the combustion chamber 25 has a metal flange 31 as the "output" electric connection 19*b*. An electrically insulating tube 32 (see FIG. 1) is arranged between the said two, "input" and respectively "output", electric connections. Extending inside the combustion chamber 25 and along its entire length between the said front opening 28 and the metal contact device 29 is at least one but preferably more electric conductors (not shown), such as thin metal wires, wool, rolled metal foil, net structures, porous thin films etc. made of, for example, aluminium, copper or steel etc. The combustion chamber 25, the contact device 29, the electric conductors and the central electrode 26 are all electrically conductive, and so the current path, the polarity of which can be changed, runs from the metal contact device 29, on to the front opening 28 of the combustion chamber 25 via the electric conductors, which are then ionized to form a very hot and expansive plasma which squirts out and ignites the propellent charge 7 through the said front opening 28. From the plasma and the front opening 28 of the combustion chamber 25, the current is conducted back to the "output" electric connection 19*b* via the casing of the combustion chamber 25. For a more detailed description of the design of the plasma torch, reference is made to our Swedish application entitled "Plasma torch for electrothermochemical weapon system, ETC round for use in such a weapon system and method for firing the said round".

METHOD AND DESCRIPTION OF FUNCTION

The method for manufacturing the cartridge case 2 and the ammunition 1 according to the embodiment comprising a casing 10 and a separate bottom piece 16 made of glass-fibre epoxy is as follows.

A first design philosophy was based on manufacturing a cartridge case 2 which was as strong as possible, that is to say that the shell 11 of the case jacket 15 would be rigid. For each winding ply/laminate layer 11, 12, 13, a fibre winding with fibre angles of essentially roughly 90° to the longitudinal axis of the tube on the inside (like on a conventional spool) and +/− roughly 20° on the outside was selected. In order to obtain an extra strong case jacket 15, many such winding plies 11, 12, 13 were laid one on top of another. It was found that such casings 10 burst during test firing due to the great risk of crack formation and the build-up of overpressure in the glass-fibre laminate. As mentioned above, it is an absolute requirement that the cartridge case 2 can be removed from the cartridge chamber after the shell has been fired. This requirement is complicated or rendered impossible if the casing 10 is not in one piece.

The current design philosophy, which forms the basis for the case 2 and the ammunition 1 according to the present embodiment of the invention, is that the casing 10 is instead essentially flexible, that is to say that the casing 10 of a round 1 introduced into the cartridge chamber tolerates being expanded towards the walls of the cartridge chamber by the inner overpressure inside the cartridge case 2 brought about when firing takes place without for that reason cracking, delaminating or disintegrating. This is achieved by sandwiching woven glass-fibre fabric between several of the thread-winding plies. In this connection, the said inner overpressure which is handled can be assumed to vary from roughly 450 MPa to at least 750 MPa depending on the calibre, type etc. of the round.

Manufacture is started by an innermost, tightly woven glass-fibre fabric first being applied to the winding and shaping tool, while it is ensured that any air bubbles are carefully pressed out of the laminate so that there is no risk of air pockets being built into the laminate. The simplest way of doing this is to rotate the tool while the fabric is draped over it. The last piece of the glass-fibre fabric is laid so that a small overlap is formed. Then, a first winding ply of glass-fibre thread in resin is laid with a fibre angle to the longitudinal axis of the tube of essentially 90°, followed by two winding plies of thread with a fibre angle of on the one hand roughly +20° and on the other hand −20°. The subsequent, thin winding plies/laminate layers 11, 12, 13 are then given a fibre winding with a fibre angle to the longitudinal axis of the tube which varies between essentially roughly 90° and +/− roughly 20° as the thickness of the casing 10 is built up to roughly half-thickness. After that, woven glass-fibre fabric and fibre windings with a fibre angle of essentially 90° are sandwiched until full case thickness has been achieved. Suitably, two cartridge cases 2 are wound simultaneously by virtue of the blank of the case 2 being manufactured in such a way that, after winding has been completed, the blank can be divided into two equal parts, the cut taking place between the rear and therefore rougher ends 6 of the two cases.

The winding speed, thread tension and hardening cycle are selected carefully so as to obtain optimum and economical manufacture. The winding speed should be relatively low, 4-6 m/min and preferably roughly 5 m/min, while the thread tension should be quite high, roughly 21-23 N/roving and preferably 22 N/roving, in order to avoid any risk of delamination. In order further to minimize the risk of delamination, use is suitably made of a hardening cycle comprising a plurality of hardenings at increasing temperatures, for example a hardening cycle of roughly 5 hours at roughly 80°, followed by roughly 5 hours at roughly 120°, after which after-hardening takes place for roughly 4 hours at roughly 140°.

After shaping of the blank for the case jacket 15, this is cut and turned/ground to the desired length, thickness and predetermined shape, for example comprising the flange 6, after which a bottom piece 16 is mounted on the rear end 6 of the case jacket 15 in a tight-fitting manner, preferably by adhesive bonding by means of epoxy adhesive, but use can also be made of screw-thread cutting or another connection (not shown) suitable for the function. Any steel components, such as the plasma torch 5 and the steel bottom 16 if one is used, are surface-treated before adhesive bonding.

When a bottom 16 made of glass-fibre epoxy is used, this can be manufactured according to two methods, either via a hammock method where only tensile loads in the fibres can occur or via a plane bottom method so that pressure loads can also occur. After shaping and hardening have been completed, the bottom piece is then turned out, attention being paid to obtaining the correct interference fit as above.

Mounting of the fuse or alternatively the plasma torch is effected via screw-thread cutting so that they can be interchanged. Mounting of the projectile, propellent charge and other components included in the finished round is carried out in a conventional way.

The method for manufacturing the cartridge case 2 and the ammunition 1 according to the embodiment comprising a metal casing 10 with electric insulation coating 12, 13 is as follows. An example of such a coating 12, 13 is what is referred to as polymer vaporization.

This coating 12, 13 is applied over a conventional cartridge case 2 via three phases comprising vaporization of a dimeric or polymeric raw material comprising hydrocarbons (plastic), such as poly-para-xylylene, the polymer or the dimer first, at roughly 150° C., being transformed from solid phase to gas phase and then, at a further increased temperature of roughly 650° C., being transformed to a reactive monomer gas which is finally made to condense (that is to say polymerize) on the cartridge case 2 which is at room temperature and under vacuum, a thin inner and outer insulating plastic film layer 12, 13 being deposited on all the free surfaces of the case 2 with a thickness of roughly 20-70μ.

The resulting highly pure, hole-free, tough and elastic polymer film 12, 13 is completely smooth and has a low friction coefficient (as a result of which the cartridge case is provided with spontaneous lubrication), high abrasion-resistance, low water absorption, and also a high dielectric constant of roughly 200 V/μm. Moreover, the polymer film is non-sensitive to gases, solvents, chemicals, water and moisture.

ALTERNATIVE EMBODIMENTS

The invention is not limited to the embodiment shown but can be varied in different ways within the scope of the patent claims. It is clear, for example, that an insulating coating and protective layer can also be obtained by means of conventional varnishing of the round and the case. Compared with the polymer vaporization described above, however, varnishing has the disadvantages of higher permeability and worse adhesion, and the varnish can also crack.

Materials other than polyethylene, glass-fibre-reinforced epoxy etc. and different thread tension, fibre angles, hardening cycles etc. and winding plies may be possible in future. It is clear that the number, size, material and shape of the elements and components included in the round 1 and the cartridge case 2, for example the bottom piece 16, the fabric, resin and thread type etc., are adapted according to the weapon system(s), calibres, active part etc. and also the surrounding environment concerned. It is therefore clear that the invention is in no way limited to the embodiments shown in particular, but that every other configuration according to the above falls within the inventive idea.

The invention claimed is:

1. A cartridge case (2) and ammunition round (1) primarily for at least one of electrothermal or electrothermochemical weapon systems wherein:

the ammunition round (1) comprises the cartridge case (2) having a casing (10), a bottom or a bottom piece (16), and a firing device (5), which firing device (5) comprises an electric connection (19) by means of which the ammunition round (1) is in electric contact with the weapon, wherein the casing (10) including the bottom or the bottom piece (16) comprises one or more insulated or insulating shells, layers or surfaces (11, 12, 13) for, at least electrically, insulating both the casing (10) of the cartridge case (2) and its bottom or bottom piece (16) from the rest of the ammunition round (1) including its firing device (5) when the round (1) is stored and handled and, when the round (1) is used, from a barrel (14) of the weapon system, wherein the casing (10) of the cartridge case (2) comprises a load-bearing case shell (11) in the form of a cartridge case (2) manufactured from an electrically conductive metal of which at least one inner or outer coating, surface or layer (12,13) is of dielectric material for the electric insulation of the cartridge case (2) in relation to the barrel (14) and also to the rest of the ammunition round (1) including the firing device (5) and the ammunition round (1).

2. The cartridge case (2) and ammunition round (1) according to claim 1, wherein the cartridge case (2) has the casing (10) which comprises at least one inner or outer coating, surface or layer (12, 13) which is a mechanically applied layer, a chemically applied layer or electrochemically applied surface.

3. The cartridge case (2) and ammunition round (1) according to claim 1, wherein the at least one inner or outer coating, surface or layer (12, 13) comprises a material applied by phase transformation, including vaporization or condensation to form an insulating film (12, 13), a dimeric or polymeric raw material comprising hydrocarbons, including poly-para-sylylene.

4. The cartridge case (2) and ammunition round (1) according to claim 1, wherein the at least one inner or outer shell or layer (11, 12, 13) comprises shape-imitating shrink film or flexible tube (11, 12, 13) made of non-conductive material, including rubber or plastic.

5. An ammunition round (1) with cartridge case (2) according to claim 4, wherein the round (1) comprises a propellent charge (7) and that the shrink film or the tube (11, 12, 13) is arranged on the outside of the said propellent charge (7).

6. The ammunition round (1) with cartridge case (2) according to claim 5, wherein the propellent charge (7) comprises a cartridge-shaped charge which is surrounded by the shrink film or the flexible tube (11, 12, 13) for forming at least one of a cartridge-shaped or vacuum-packed round (1) which stands up to normal handling of the round (1).

7. The cartridge case (2) and ammunition round (1) according to claim 1, wherein the casing (10) of the cartridge case (2) comprises a non-conductive or electrically insulating load-bearing material, shell, layer or surfaces (11, 12, 13), including hard plastic, ceramic, rigid rubber, or fiber composite.

8. The cartridge case (2) and ammunition round (1) according to claim 1, wherein the casing (10) of the cartridge case (2) comprises a relatively flexible non-conductive or electrically insulating shell or layer (11, 12, 13) which is constructed from a glass-fiber laminate.

9. The cartridge case (2) and ammunition round (1) according to claim 8, wherein the casing (10) of the cartridge case (2)

has a glass-fiber thread winding which is arranged along the case jacket (15) at a winding angle α defined for each ply to the longitudinal axis Y of the case (2).

10. The cartridge case (2) and ammunition round (1) according to claim 1, wherein the firing device (5) is arranged detachably on a bottom (16) integrated with the casing (10) of the cartridge case (2).

11. The cartridge case (2) and ammunition round (1) according to claim 1, wherein the firing device (5) is arranged detachably on a separate bottom piece (16) arranged demountably with the casing (10) of the cartridge case (2).

12. The cartridge case (2) and ammunition round (1) according to claim 1, wherein the bottom piece (16) is made of glass-fiber epoxy, and arranged to fit tightly on the casing (10) by a connection means including screw-thread cutting or adhesive bonding.

13. The ammunition round (1) with cartridge case (2) according to claim 1, wherein the firing device (5) comprises a plasma torch (5).

14. The ammunition round (1) with cartridge case (2) according to claim 1, wherein the firing device (5) of the ammunition round (1) comprises a fuse for use of the cartridge case (2) and the ammunition round (1).

15. Method for manufacturing a cartridge case (2) and an ammunition round (1) primarily for electrothermal and/or electrothermochemical weapon systems, which round (1) comprises a cartridge case (2) according to claim 1, characterized in that at least one of the shells or layers (11, 12, 13) which form part of the casing (10) of the cartridge case (2) is manufactured by glass-fiber thread being wound with resin in layers with varying winding angles α sandwiched with woven glass-fiber fabric so that a plurality of winding plies/laminate layers (11, 12, 13) are obtained after hardening.

16. Method for manufacturing a cartridge case (2) and an ammunition round (1) according to claim 15, characterized in that for every such winding ply/laminate later (11, 12, 13), a fiber winding with fiber angles of essentially roughly 90° to the longitudinal axis of the tube on the inside and +/− roughly 15-25°, preferably +/− 20°, on the outside is selected, and in that a number of such winding plies (11, 12, 13) are laid on top of one another and sandwiched with woven glass-fiber fabric between a number of the thread-winding plies so that an essentially flexible case jacket (15) is obtained, as a result of which the casing (10) of a round (1) introduced into the cartridge chamber tolerates being expanded towards the walls of the cartridge chamber by the inner overpressure inside the cartridge case (2) brought about when firing takes place without for that reason cracking, delaminating or disintegrating.

17. Method for manufacturing a cartridge case (2) and an ammunition round (1) according to claim 1, characterized in that at least one of the shells or layers (11, 12, 13) which form part of the casing (10) of the cartridge case (2) is manufactured by a glass-fiber being applied to a winding and shaping tool which is rotated while the fabric is draped over it, the last piece of the woven glass-fiber fabric being laid so that a small overlay is formed, after which a first winding ply of glass-fiber thread in resin is wound with a fiber angle to the longitudinal axis of the tube of essentially 90°, followed by two or more winding plies of thread with a fiber angle, which is varied for the component plies, of on the one hand roughly +15-25°, preferably +20, after which the subsequent, winding plies/laminate layers (11, 12, 13) are also given a fiber winding with a fiber angle to the longitudinal axis of the tube which varies between essentially roughly 90° and +/− roughly 15-25°, preferably +/−20°, as the thickness of the casing (10) is built up to roughly half-thickness, after which woven glass-fiber fabric is sandwiched with fiber windings with a fiber angle of essentially 90° until full shell or layer (11, 12, 13) thickness has been achieved.

18. Method for manufacturing a cartridge case (2) and an ammunition round (1) according to claim 1, characterized in that a relatively low winding speed is used, preferably roughly 4-6 m/min, while a relatively high thread tension, roughly 21-23 N/roving, and a hardening cycle which comprises a plurality of hardenings at increasing temperatures are selected.

19. Method for manufacturing a cartridge case (2) and an ammunition round (1) according to claim 18, characterized in that use is made of a hardening cycle of roughly 5 hours at roughly 80°, followed by roughly 5 hours at roughly 120°, after which after-hardening takes place for roughly 4 hours at roughly 140°.

20. Method for manufacturing a cartridge case (2) and an ammunition round (1) according to claim 1, characterized in that after shaping of a blank for the casing (10), this is cut and/or turned/ground to essentially the desired length, thickness and predetermined shape, after which a bottom piece (16) is mounted on the rear end (6) of the casing (10) in a tight-fitting manner, preferably by adhesive bonding or screw-thread cutting.

21. Method for manufacturing a cartridge case (2) and an ammunition round (1) according to claim 1, characterized in that the bottom piece (16) is manufactured from glass-fiber epoxy, either by glass-fiber thread and/or woven glass-fiber fabric being given during shaping the form of a hammock where only tensile loads in the fibers can occur or by glass-fiber thread and/or woven glass-fiber fabric being given during shaping the form of a plane bottom so that pressure loads also can occur, after which the bottom piece (16), after shaping and hardening have been completed, is then turned out.

22. Method for manufacturing a cartridge case (2) and an ammunition round (1) comprises a cartridge case (2) according to claim 1, characterized in that an insulation coating (12, 13) is applied over all the shell or layer surfaces of the cartridge case (2) concerned which are accessible to gas by phase transformation via a number of phases, a dimeric or polymeric raw material being vaporized so that the polymer or the dimmer is first transformed from solid phase to gas phase and then, at a further increased temperature, is transformed to a reactive monomer gas which is made to condense and polymerize, a thin insulating plastic film layer (12, 13) being deposited on all the free surfaces of the cartridge case (2).

23. Method for manufacturing a cartridge case (2) and an ammunition round (1) according to claim 22, characterized in that the condensation of the reactive monomer gas to form an insulating film (12, 13) takes place under low pressure, preferably in a vacuum.

24. Method for manufacturing a cartridge case (2) and an ammunition round (1) primarily for electrothermal and/or electrothermochemical weapon systems, which round (1) comprises a cartridge case (2) according to claim 1, characterized in that an insulation coating (12, 13) is applied over all the shell or layer surfaces of the cartridge case (2) concerned which are accessible to gas by phase transformation via a number of phases, a dimeric or polymeric raw material being vaporized so that the polymer or the dimmer is first transformed from solid phase to gas phase and the, at a further increased temperature, is transformed to a reactive monomer gas which is made to condense and polymerize, a thin insulating plastic film layer (12, 13) being deposited on all the free surfaces of the cartridge case (2).

25. Method for manufacturing a cartridge case (2) and an ammunition round (1) according to claim 24, characterized in that the condensation of the reactive monomer gas to form an insulating film (12, 13) takes place under low pressure, preferably in a vacuum.

* * * * *